US007094116B2

(12) United States Patent
Costa

(10) Patent No.: US 7,094,116 B2
(45) Date of Patent: Aug. 22, 2006

(54) HINGEABLE COMPONENT CARRIER

(76) Inventor: Larry J. Costa, 55613 Currant Rd., Mishawaka, IN (US) 46545

( * ) Notice: Subject to any disclaimer, the term of this patent is extended or adjusted under 35 U.S.C. 154(b) by 614 days.

(21) Appl. No.: 10/103,188

(22) Filed: Mar. 19, 2002

(65) Prior Publication Data

US 2002/0098746 A1 Jul. 25, 2002

Related U.S. Application Data

(63) Continuation-in-part of application No. 09/507,974, filed on Feb. 22, 2000, now abandoned.

(51) Int. Cl.
*H01R 13/02* (2006.01)
*H01R 9/24* (2006.01)

(52) U.S. Cl. ..... 439/885; 439/13

(58) Field of Classification Search ..... 439/885, 439/78, 83

See application file for complete search history.

(56) References Cited

U.S. PATENT DOCUMENTS

| | | | | |
|---|---|---|---|---|
| 4,187,606 A | | 2/1980 | Sinclair | 29/629 |
| 4,502,745 A | * | 3/1985 | Chavers et al. | 439/83 |
| 5,702,258 A | * | 12/1997 | Provencher et al. | 439/79 |
| 5,730,608 A | | 3/1998 | Legrady | 439/78 |
| 5,957,739 A | * | 9/1999 | Bianca et al. | 439/885 |
| 6,083,060 A | | 7/2000 | Chen et al. | 439/885 |
| 2002/0098746 A1 | | 3/2002 | Costa | |

FOREIGN PATENT DOCUMENTS

TW 345336 11/1998

OTHER PUBLICATIONS

Product sign-off for Antaya drawing No. 2282-X45L, dated Dec. 8, 1999 and Jan. 26, 2000.

Antaya engineering Drawing of the formation of Antaya terminal strip No. E4C while passing through the forming die, showing opposed pairs of connectors attached to apertured carriers with a thickness less than the base pads of the connectors, dated Dec. 11, 1991.

Antaya sales invoice No. 6875-2207A for 8000 E43B terminal clip connectors, dated Mar. 29, 1999.

Materials forwarded to Applicant's attorneys of record, including Nov. 7, 2002 cover letter, Patent Application Publication No. US2002/0098746 A1, Antaya engineering drawing No. AZ-0417-X45, Antaya engineering drawing No. 2221-Z45 of X45 connectors with apertured carriers, Antaya engineering drawing of WJC connectors with apertured carriers and Antaya sales invoice No. 0004707.

Copy of first page of Nov. 7, 2002 cover letter to Applicant's attorneys of record with Federal Express tracking number.

Memorandum evidencing telephone conversation with the assistant to Shane niebergall, Applicant's patent attorney, confirming receipt of the Nov. 7, 2002 package, dated Nov. 18, 2002.

(Continued)

*Primary Examiner*—Chandrika Prasad
(74) *Attorney, Agent, or Firm*—Thomte, Mazour & Niebergall; Shane M. Niebergall

(57) ABSTRACT

The progressive die tooling component carrier is adapted to serve as a hinge connection between the components that it connects. The carrier allows for the reeling of a series of components for storage and transportation without causing the warping or bending of the components. Preferably, the hinge connection is achieved by providing the carrier with a compression, a perforation, or both a compression and a perforation. The carrier is designed to further minimize the scrap resulting from the removal of the carrier from the adjoining components.

8 Claims, 6 Drawing Sheets

OTHER PUBLICATIONS

U.S. Patent Office PAIR page for U.S. Appl. No. 10/103,188 indicating the absence of a supplelmental Information Disclosure Statement filed subsequent to the receipt of the Nov. 7, 2002 package by the Applicant's attorneys of record.

Antaya engineering drawing of the formation of the Antaya W.J.C. terminal strip while passing through the forming die showing Antaya W.J.C. connectors attached to apertures carries, dated Jul. 18, 1990.

Antaya sales invoice No. 0004707 for 14,000 W.J.C. terminal clip connectors, dated Nov. 19, 1996.

Antaya engineering drawing No. AZ-0417-X45 of Antaya X45 connector, dated Jun. 11, 1996.

Part submission warrant to customer for the Antaya X45 connector of Antaya engineering drawing No. AZ-0417-X45, dated Jun. 16, 1996.

Antaya engineering drawing No. 2221-X45 of Antaya X45 connectors attached to apertured carriers, dated May 5, 1999, with Antaya drawing Nos. 2281-X45R and 2282-X45L superimposed thereon.

Antaya engineering drawing No. 2281-X45R of Antaya X45 connectors attached to apertured carriers, dated Dec. 6, 1999.

Antaya engineering drawing No. 2282-X45L of Antaya X45 connectors attached to apertured carriers, dated 6, 1999.

Product sign-off for Antaya drawing No. 2281-X45R, dated Dec. 8, 1999 and Jan. 26, 2000.

* cited by examiner

HINGEABLE COMPONENT CARRIER

CROSS-REFERENCE TO RELATED APPLICATION

This is a continuation-in-part application of Petitioner's earlier application Ser. No. 09/507,974 filed Feb. 22, 2000, now abandoned, entitled PROGRESSIVE DIE TOOLING COMPONENT CARRIER.

BACKGROUND OF THE INVENTION

The present invention relates to a progressive die tooling component carrier which provides a hinge connection between adjacent components for storage and transportation prior to separation and implementation.

DESCRIPTION OF THE PRIOR ART

Progressive die tooling is used to produce high volume precision components for manufacturing purposes. Progressive die tooling components are used in a number of industries, but are used primarily in mass production. In progressive die tooling, the components to be manufactured can be connected directly to each other in series, but more commonly, such components are connected by a carrier, described below. If, for instance, a series of metal components were to be produced for progressive die tooling, the raw material employed in the process would comprise a strip of metal. The metal would be stamped to provide a series of desired components. The components would ordinarily be connected by a small amount of the metal strip, known as a carrier. The carrier would be removed from the components by a punch or similar tool prior to the implementation of the component.

The design of the carrier is determined by the design of the tooling, the associated component, and the application of the component. To minimize the amount of waste that is produced when the carrier is separated from the component, the carrier is usually joined to the base features of consecutive components.

Prior art progressive die tooling component carriers have customarily comprised a solid piece of metal having the same thickness as the component. In instances where minimization of scrap material has been important, the prior art progressive die tooling component carriers have had a shortened length or width. A carrier with a shortened length prevents reeling of the integrated components because of the rigidity of its connection with the components. Reeling of components having carriers of shortened length can result in bent or warped components, which is undesirable. Similarly, carriers with shortened widths allow for the twisting, or relative rotation, of adjacent components. The twisting of the components makes precision automated work difficult.

Other prior art progressive die tooling component carriers, such as those disclosed in U.S. Pat. No. 5,730,608, teach the use of a pair of rectangular carrier arms, such as the component carrier 5 depicted in FIG. 1C. The carrier arms 6 and 7 are positioned in parallel spaced relation to one another, connecting the adjacent components 8 and 9 to one another. This type of carrier becomes problematic when the adjacent components 8 and 9 are subjected to a twisting motion. The twisting motion forces one end of each carrier arm upward and the opposite end downward forming a pair of hinges A and B in each of the carrier arms, such as those depicted in FIG. 1D, as the components are wound around a reel. Each of the hinges A and B will tend to bend along different axes, thus creating an additional force on the carriers that makes them more likely to fracture as the reeled components are unreeled prior to assembly. Moreover, the formation of multiple hinges in each of the carriers will alter the uniform distance between the components, as depicted in FIG. 1E, making precision positioning of the components more difficult.

The difficulty in forming a single hinge in such prior art carriers is further compounded by the inability to accurately determine the point at which each carrier will bend. The components are far more likely to become entangled as they are wound onto a reel when each of the carriers is hinged at a different point. Consistently locating the hinge point of each carrier will greatly reduce the occurrence of tangled components as well as multiple axes hinging.

Accordingly, what is needed is a progressive die tooling component carrier that enables a strip of formed components to be easily wound onto a reel, resists twisting of the components relative to one another, and reduces the scrap formed when the carrier is separated from the components.

SUMMARY OF THE INVENTION

The progressive die tooling component carrier of this invention is adapted to create and accurately locate a single hinge between the components that it connects. Therefore, the carrier of the present invention allows for the reeling of a series of components for storage and transportation without causing the reeled components to tangle, warp or bend.

In one embodiment of the present invention, a hinge connection is achieved between adjacent components by providing a compression in the carrier. In another embodiment, the hinge connection is achieved by forming a shaped perforation in the carrier. The compression and the perforation methods are combinable into yet another embodiment. Each of these different embodiments provides the additional benefit of reducing the amount of waste material produced when the carrier is separated from the components.

It is therefore an object of this invention to provide a progressive die tooling component carrier that provides a hinge connection between the components to which it is connected.

It is a further object of this invention to provide a progressive die tooling component carrier that allows for the reeling of a series of components without causing the tangling, warping or bending of the components.

It is yet another object of the invention to provide a progressive die tooling component carrier that results in the minimization of waste material produced when the carrier is severed from the component to which it is attached.

It is a further object of the invention to provide a progressive die tooling component carrier that substantially prevents relative rotation of the components about their longitudinal axes.

It is yet another object of the invention to provide a progressive die tooling component carrier that is shaped to prevent the formation of multiple hinges between pairs of adjacent components.

It is a further object of the invention to provide a progressive die tooling component carrier that forms a hinge at a predetermined location along the length of the carrier.

These and other objects of the invention will be apparent to those familiar with the art.

DESCRIPTION OF THE PREFERRED EMBODIMENT

Figure 1A:
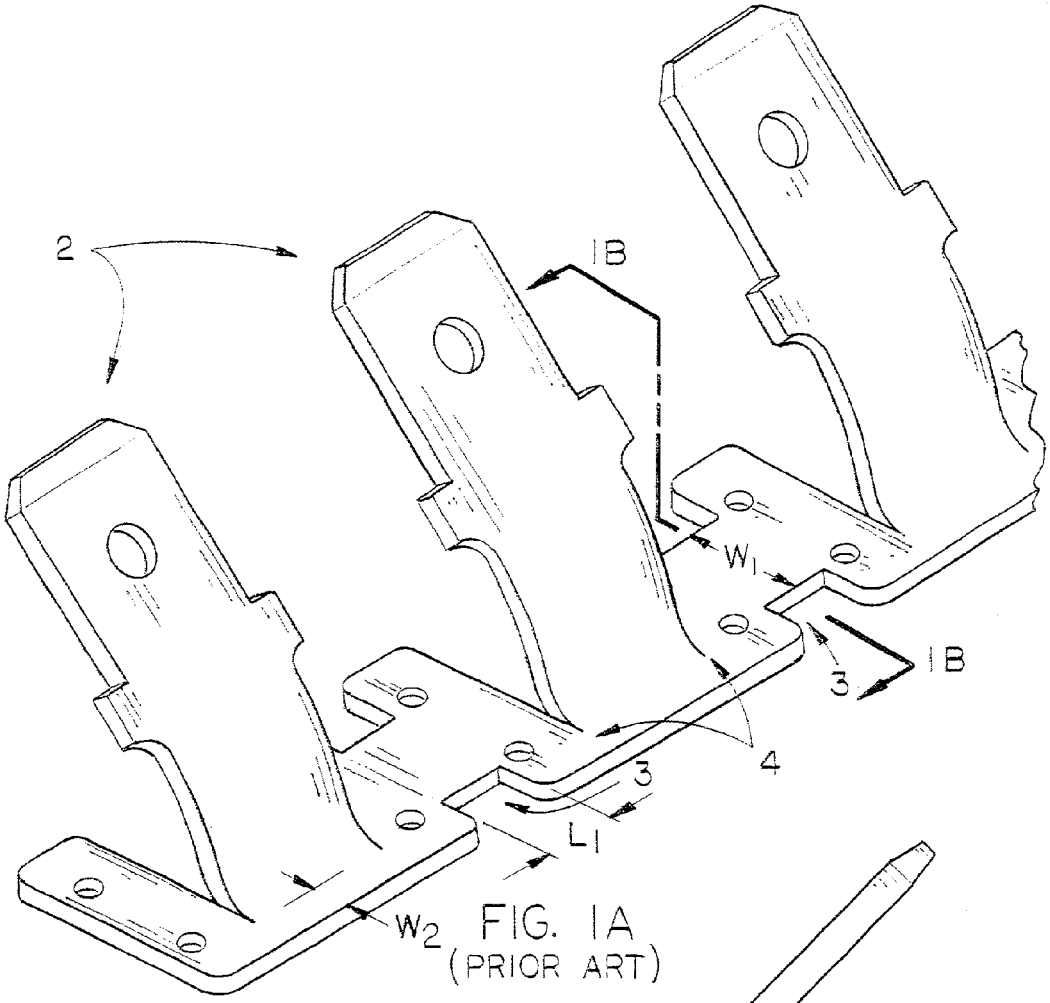
FIG. 1A (PRIOR ART)
FIG. 1A is an isometric view of a series of components joined by prior art progressive die tooling component carriers.
Figure 1B:
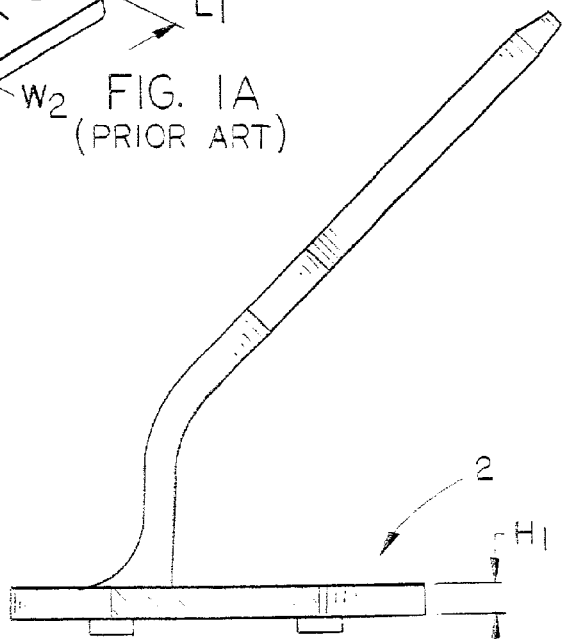
FIG. 1B (PRIOR ART)
FIG. 1B is a side sectional view of the same.
Figure 1C:
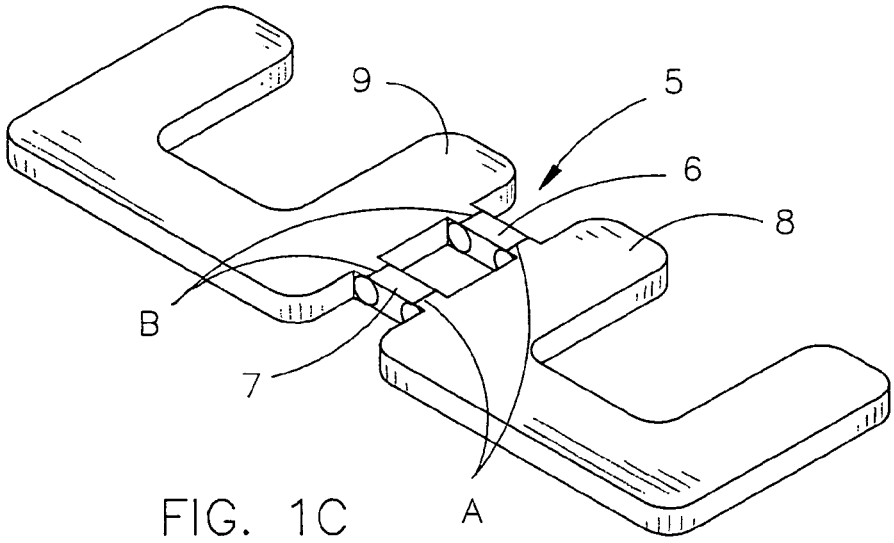
FIG. 1C (PRIOR ART)
FIG. 1C is an isometric view of a series of components joined by an alternate prior art progressive die tooling component carrier.

The numeral 2 indicates prior art progressive die tooling components having prior art progressive die tooling component carriers 3 therebetween. Although the progressive die tooling components 2 shown are electrical terminals, the structure of this invention may be used with any progressive die tooling components. As seen in FIGS. 1A and 1B, the prior art carriers have a length ($L_1$), width ($W_1$), and thickness ($H_1$). The thickness ($H_1$) of the prior art progressive die tooling component carriers 3 is equivalent to the thickness of the prior art progressive die tooling components 2 as shown in FIG. 1B.

The prior art progressive die tooling component carriers 3 have several shortcomings. It is often desirable to reel the progressive die tooling components 2 for transportation or storage. The prior art progressive die tooling component carriers 3, as shown in FIG. 1A, occasionally have a width ($W_1$) that is greater than the width ($W_2$) of the component 2. The reeling of the prior art progressive die tooling components 2 places stress on the components orthogonal to the longitudinal axis of the components. The integrated components 2 and prior art carriers 3 tend to deflect or bend at their weakest points. As shown in FIG. 1A, the weakest point in the integrated carriers and components would likely be the point indicated by numeral 4. If, however, the width ($W_1$) of the prior art progressive die tooling component carrier 3 were made smaller than the width ($W_2$) of the component, the components 2 would be subject to twisting or relative rotation about the longitudinal access of the components. Such rotation is undesirable in precision tooling.

Furthermore, the length ($L_1$) or the width ($W_1$) of the prior art carriers 3 has often been minimized to reduce the amount of waste material in a die tooling operation. Although the reduction of waste is an important goal, as previously stated, reduction of the width ($W_1$) of the prior art carriers 3 results in the potential twisting of the components 2. In addition, reduction of the length ($L_1$) of the prior art carriers 3 results in greater stress on the components 2 at their weakest points 4 when the components are reeled for transportation or storage.

Figure 2A:
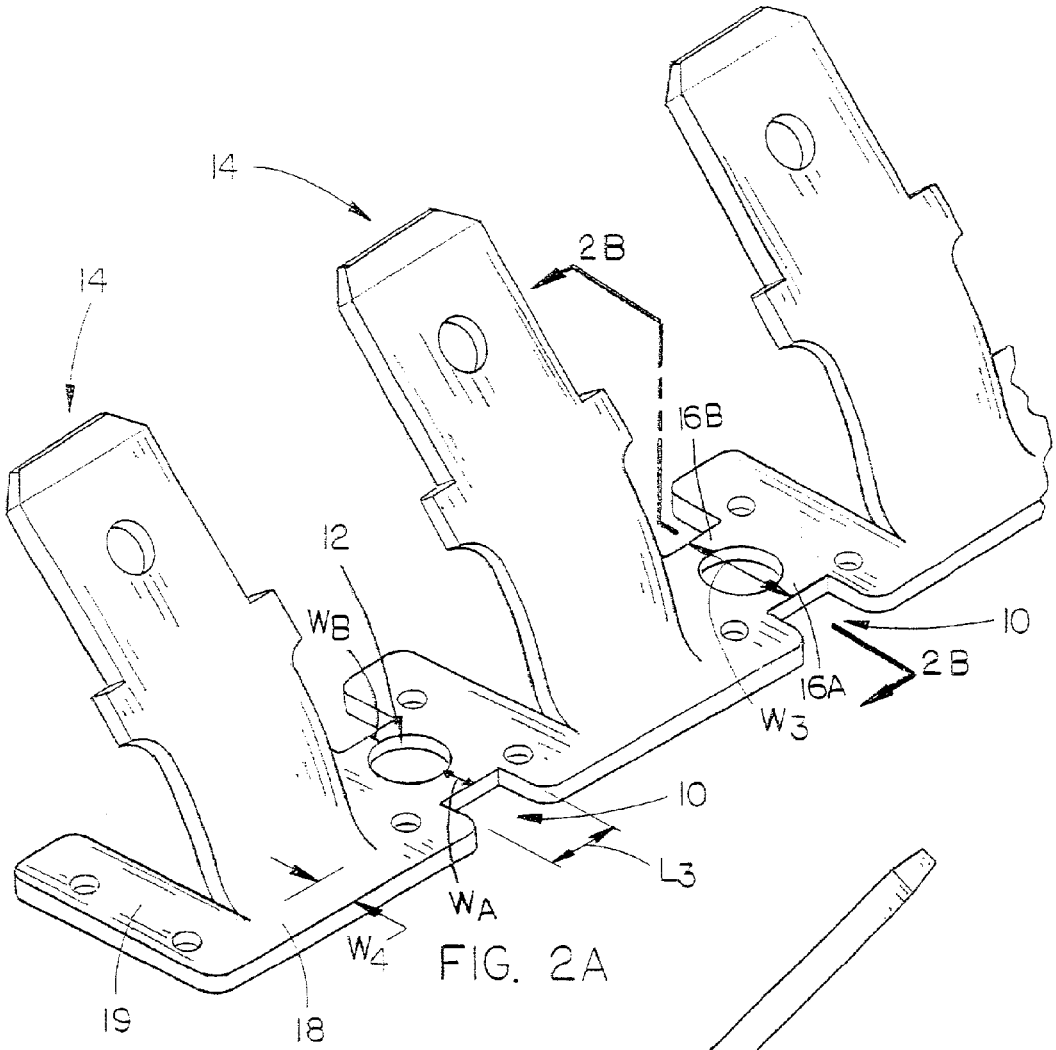
FIG. 2A is an isometric view of a series of components joined by the progressive die tooling component carriers of this invention employing a perforation.
Figure 2B:
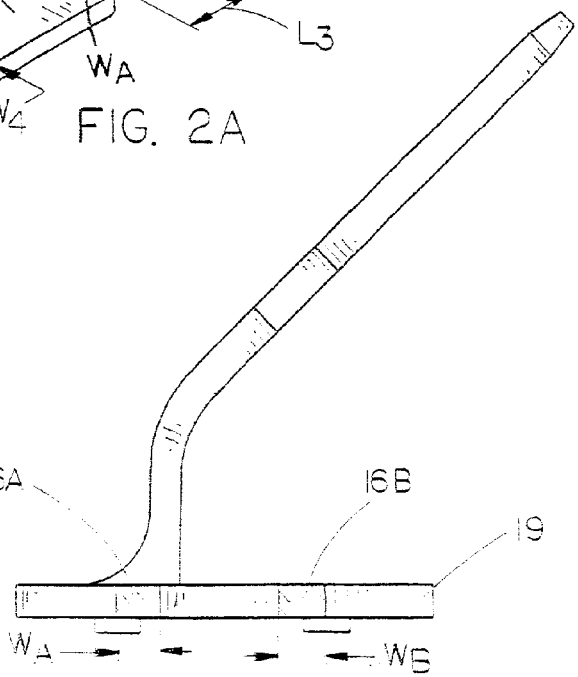
FIG. 2B is a side sectional view of the same.

The numeral 10 refers generally to an embodiment of the progressive die tooling component carrier of this invention. As shown in FIG. 2A, the carrier 10 has a length ($L_3$) and a width ($W_3$). The carrier 10 is shaped to also include a perforation 12. The width ($W_3$) of the carrier 10 is sufficient to prevent the twisting of the components 14 relative to one another. Preferably, the carrier arms 16A and 16B have a combined width at their narrowest points ($W_A$+$W_B$) that is less than the width ($W_4$) of the component 14 at its narrowest point 18 in order to prevent twisting of the component 14.

In use, the carrier 10 is separated from the components 14 in conventional fashion, usually by a punch. It is preferred that the carrier be completely separated from the adjoining components. Leaving small portions of the carrier attached to the components will result in an uneven component edge. The uneven edge will often render the component incompatible with glass or ceramic substrates. The uneven edge causes stress points on the substrate when the solder used to connect the component to the substrate cools.

The carrier 10, once separated, constitutes waste. It is preferred that the perforation 12 extends across the length ($L_3$) of the carrier 10 so that the perforation 12 exposes a portion of the component edge. This will help minimize waste in at least two different ways. First, the perforated carrier will comprise less material than a non-perforated carrier. Second, the carrier will be broken into two or more smaller pieces as it is removed from the adjoining carriers, allowing for easier removal by conventional vacuum methods.

Figure 1D:
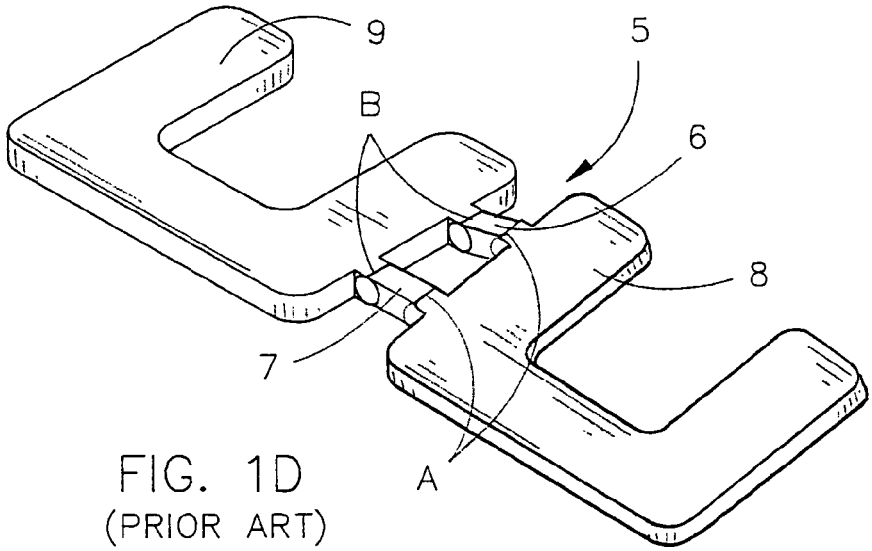
FIG. 1D (PRIOR ART)
FIG. 1D is an isometric view of the prior art components and carrier of FIG. 1C where the components are slightly twisted with respect to one another.
Figure 1E:
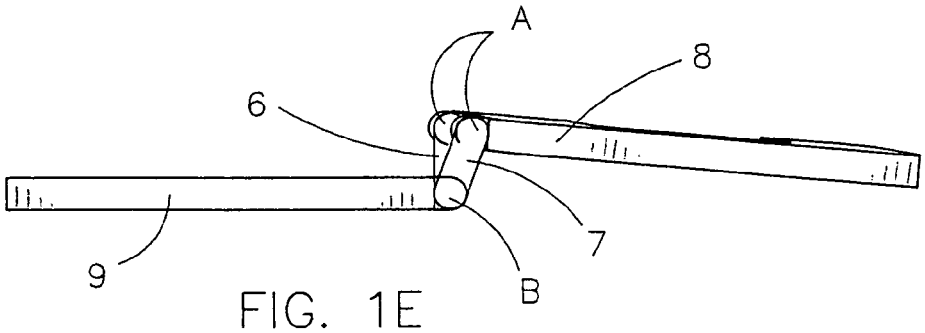
FIG. 1E (PRIOR ART)
FIG. 1E is an isometric view of the prior are components and carrier of FIG. 1D after additional twisting forces are exerted on the components.
Figure 2C:
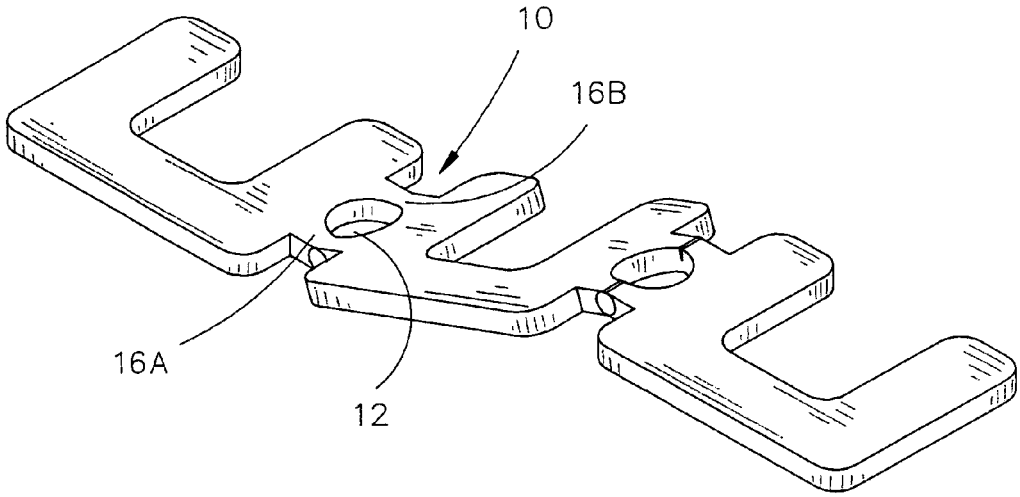
FIG. 2C is an isometric view of one embodiment of the perforated progressive die tooling component carrier of the present invention joining a plurality of components to one another during a bending operation.
Figure 2D:
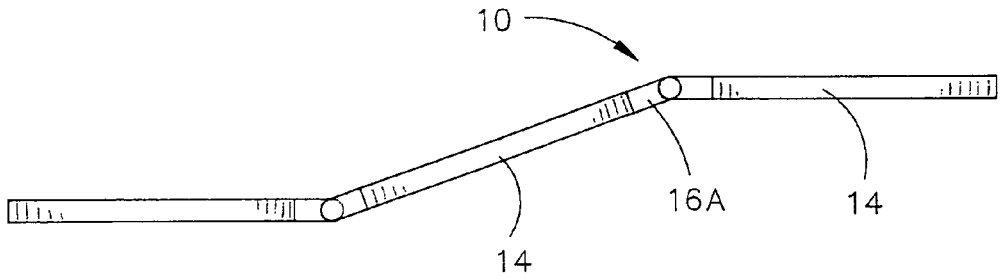
FIG. 2D is a side elevation view of the components and carriers of FIG. 2C.

The carriers 10 shown in FIG. 2A are ideally suited for reeling of the components for storage and transportation. Unlike prior art carriers, the carrier 10 will tend to bend or deflect at a single predetermined line indicated at 2B, which intersects the carrier arms 16A and 16B at the points of narrowest width, $W_A$ and $W_B$. Changing the shape of perforation 12, or its location in carrier 10, so that the narrowest width portions $W_A$ and $W_B$ are moved to different locations along the length of carrier 10, will selectively change the location of the carrier hinge. By bending the carrier at the line 2B, the base 19 of the components 14 are maintained in a substantially flat condition. Accordingly, a single hinge with a single axis is selectively located and maintained in carrier 10 throughout a reeling operation as despicted in FIG. 2C and FIG. 2D. Prior art carriers using parallel carrier arms of uniform width will tend to twist and form two different hinges in the carrier with different axes as shown in FIG. 1D and 1E, putting a greater stress on the carrier and rendering precision work with such a carrier difficult at best.

Although perforation 12 can be formed in virtually any shape, it is preferred that perforation 12 at least be shaped to provide carrier arms 16A and 16B with curved inner edges, extending at least partially along the length of carrier 10. The curved inner edges will provide the requisite narrow width portions $W_A$ and $W_B$. They will also tend to provide greater structural integrity to the hinge formed in the carrier 10 than edges having an angular shape.

Figure 3A:
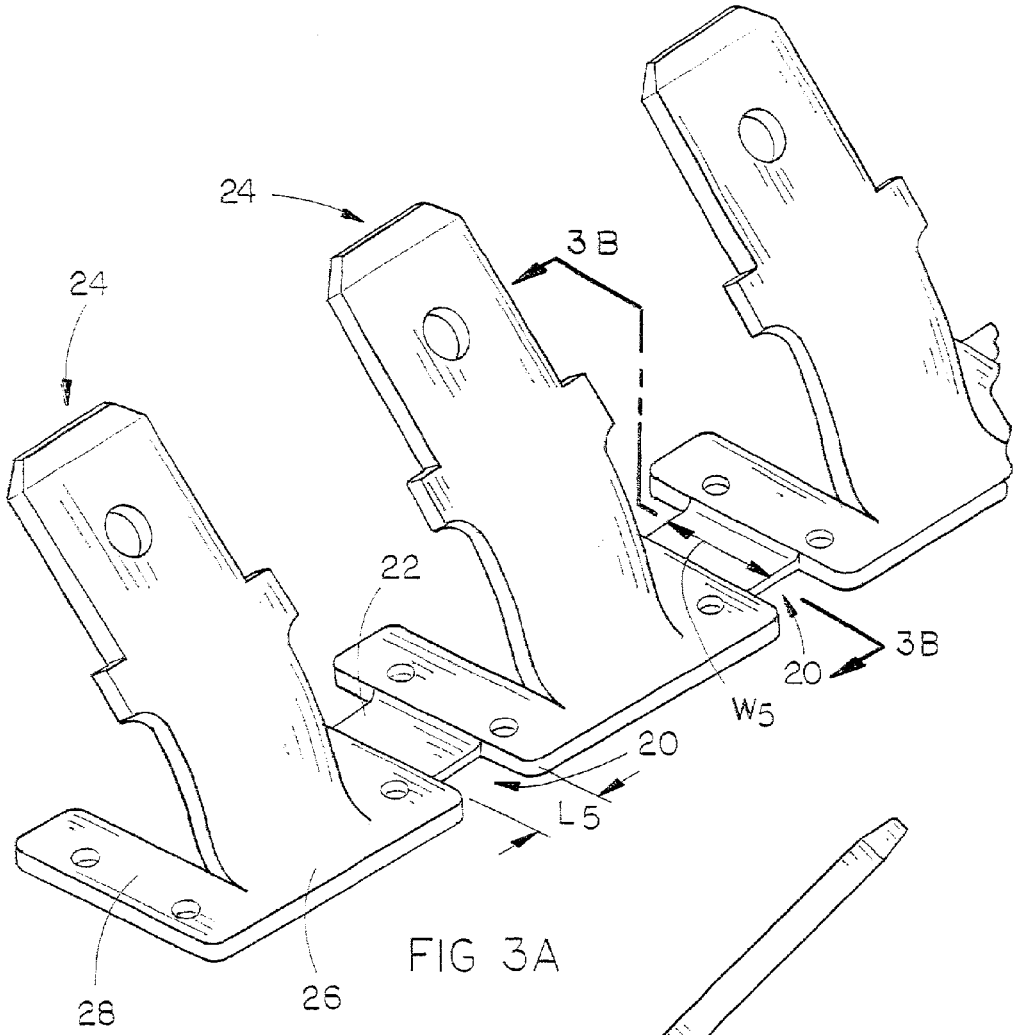
FIG. 3A is an isometric view of a series of components joined by progressive die tooling component carriers of this invention employing a compression.
Figure 3B:
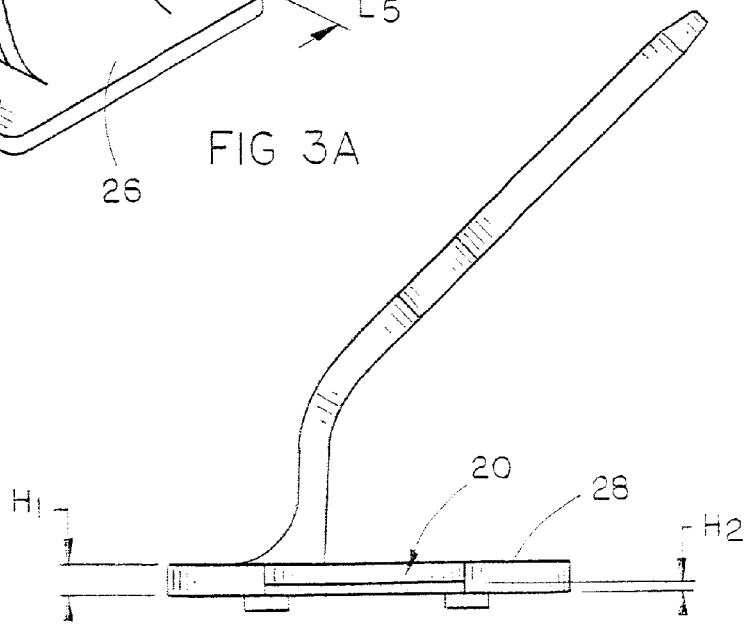
FIG. 3B is a side sectional view of the same.

A second embodiment of the carrier of this invention is shown in FIGS. 3A and 3B and is indicated by numeral 20. The carrier 20 has been shaped to have a compression 22 extending across the width ($W_5$) thereof. The compression 22 is perpendicular to the longitudinal axis of the components 24 and reduces the thickness ($H_2$) of the carrier 20 relative to the thickness ($H_1$) of the components 24. It is contemplated that the reduced thickness of the carrier 20 could be achieved by the removal of material by known means or by compression. Although the width ($W_5$) of the carrier 20 is greater than that of the narrowest part of the component 26, the carrier 20 will provide a single hinge connection between components 24. Accordingly, only one hinge axis can be formed along the length of the carrier. The compression 22 provides a natural bending point at the line indicated by line 3B. In use, the components 24 may be reeled and the base 28 of each component 24 will be maintained in a substantially flat condition.

Due to compression 22, the carrier 20 may have a length ($L_5$) that is comparatively short, but that provides the desired hinge connection. The shortened length ($L_5$) results in less material that needs to be separated from the components 24, minimizing waste.

Figure 4A:
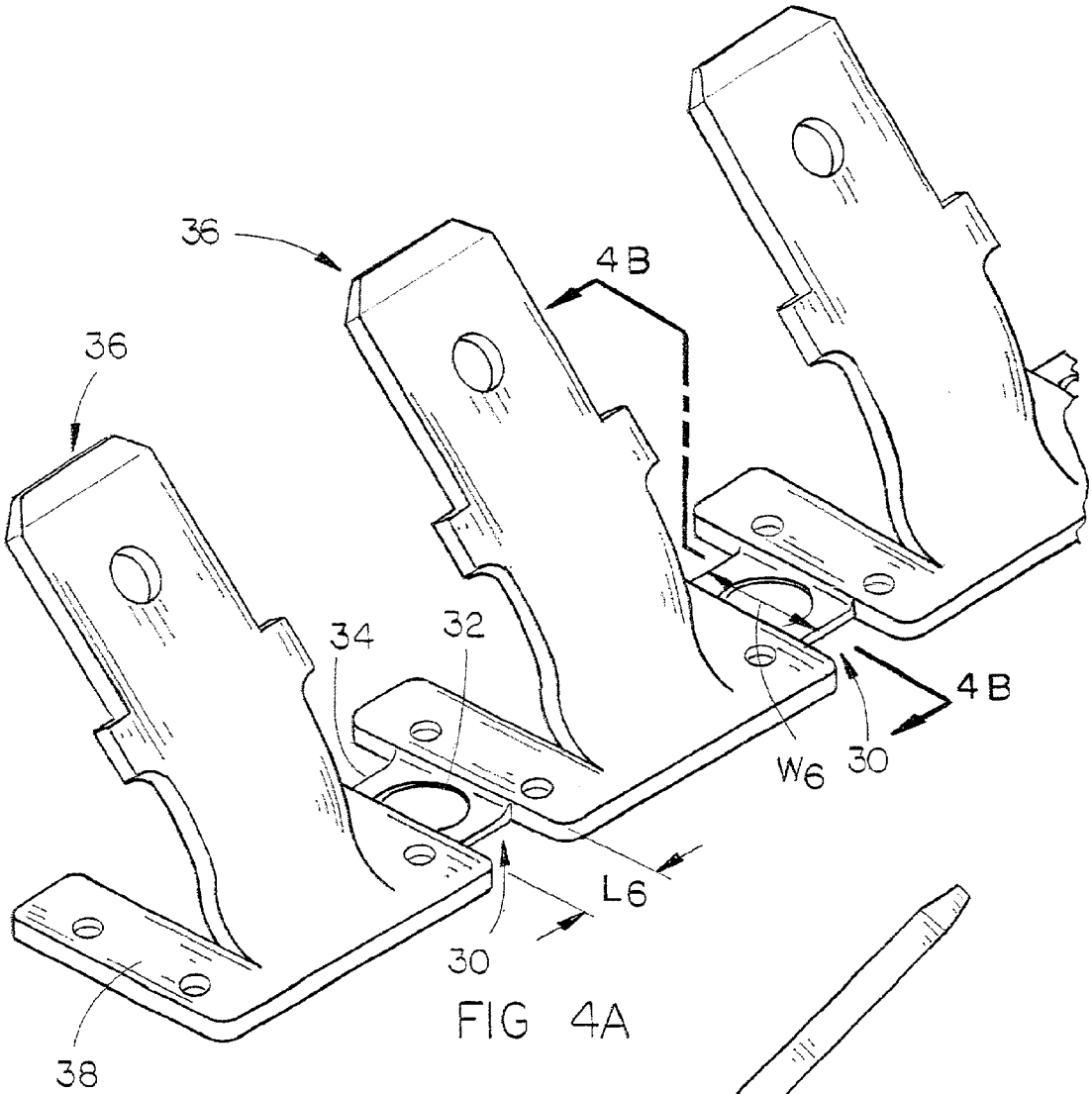
FIG. 4A is an isometric view of a series of components joined by progressive die tooling component carriers of this invention employing both a perforation and a compression.
Figure 4B:
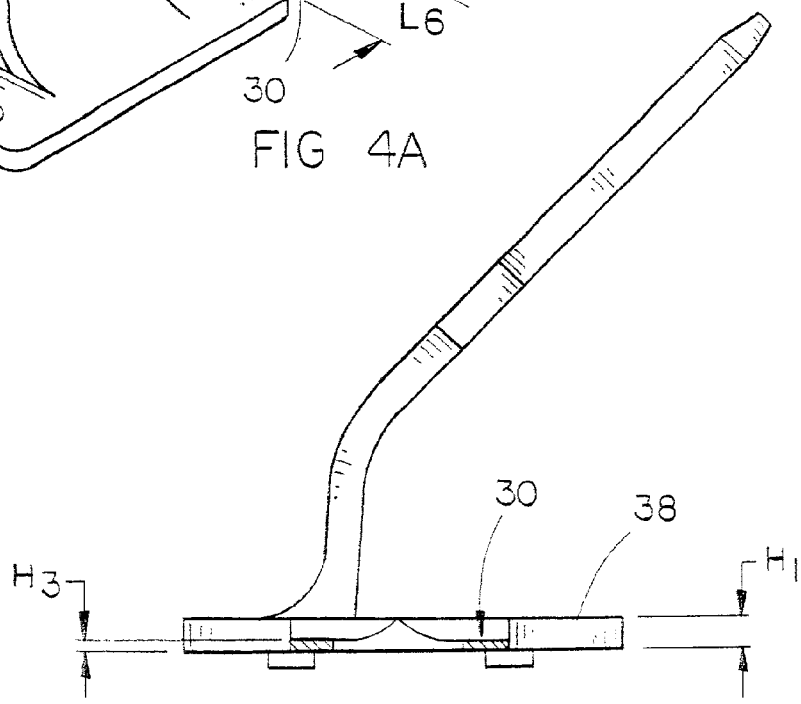
FIG. 4B is a side sectional view of the same.

A third embodiment of the carrier 30 of this invention is shown in FIGS. 4A and 4B. The carrier 30 has a length ($L_6$), an overall width ($W_6$), a perforation 32, and a compression 34. The carrier 30 employs the benefits of carriers 10 and 20 previously described. The perforation 32 provides a natural hinge connection between components 36 and also minimizes waste material. As shown in FIG. 4B, the compression 34 has a thickness ($H_3$) that is less than the thickness ($H_1$) of the base portion 38 of the component 36. The compression 34 extends across the width ($W_6$) of the carrier 30 and also provides a hinge connection between components 36. Like the previously described carriers 10 and 20, the carrier 30 allows for the reeling of components 36 while maintaining the base portion 38 of the components in a substantially flat condition. The carrier 30 also consists of less material than prior art carriers, minimizing waste caused by separation of the carrier 30 from the components 36.

In the drawings and in the specification, there have been set forth preferred embodiments of the invention; and although specific items are employed, these are used in a generic and descriptive sense only and not for purposes of limitation. Changes in the form and proportion of parts, as well as substitute of equivalents, are contemplated as circumstances may suggest or render expedient without departing from the spirit or scope of the invention as further defined in the following claims.

Thus, it can be seen that the invention achieves at least all of the stated objectives.

I claim:

1. A progressive die tooling component carrier for hingedly connecting first and second components, comprising:

a generally planar tab, having a length extending between first and second ends, width perpendicular to said length and a perforation formed through said tab intermediate its first and second ends; said first end of said tab being integrally connected to the first component and said second end of said tab being integrally connected to the second component so that the length of said tab extends between the first and second components;

said perforation forming first and second carrier arms; said carrier arms each having a length and a width that varies along the length to resist the unintentional formation of multiple hinge axes between the first and second components when the first and second components are moved with respect to one another;

said tab being formed to have a width sufficient to substantially prevent the tab from twisting about an axis extending parallel to its length.

2. The progressive die tooling component carrier of claim 1 wherein said perforation forms first and second carrier arms having generally curved inner edge portions extending at least partially along the length of said tab.

3. The progressive die tooling component carrier of claim 1 wherein said perforation extends substantially along the length of said tab so that the carrier is divided into at least two separate pieces when it is removed from the first and second components.

4. The progressive die tooling component carrier of claim 1 further comprising means for reducing scrap when the carrier is separated from the first and second components.

5. The progressive die tooling component carrier of claim 1 further comprising means for predetermining the location of a single axis along the length of said tab where it will bend when the first and second components are wound about a common axis.

6. A progressive die tooling component carrier for hingedly connecting first and second components, comprising:

a generally planar tab, having a length extending between first and second ends, a width perpendicular to said length and a perforation formed through said tab intermediate said first and second ends; said first end of said tab being operatively connected to the first component and said second end of said tab being operatively connected to the second component so that the length of said tab extends between the first and second components;

said tab being shaped to be comparatively thinner in cross-section than the first and second components to resist the unintentional formation of multiple hinge axes between the first and second components when the first and second components are moved with respect to one another;

said tab being formed to have a width sufficient to substantially prevent the tab from twisting about an axis extending parallel to its length.

7. The progressive die tooling component carrier of claim 6 wherein said perforation forms first and second carrier arms having generally curved inner edges extending at least partially along the length of said tab.

8. The progressive die tooling component carrier of claim 7 wherein said perforation extends substantially along the length of said tab so that the carrier is divided into at least two separate pieces when it is removed from the first and second components.

* * * * *